US006869522B2

(12) United States Patent
Khare et al.

(10) Patent No.: US 6,869,522 B2
(45) Date of Patent: Mar. 22, 2005

(54) DESULFURIZATION PROCESS

(75) Inventors: Gyanesh P. Khare, Kingwood, TX (US); Bryan W. Cass, Bartlesville, OK (US); Donald R. Engelbert, Copan, OK (US); Edward L. Sughrue, Bartlesville, OK (US); Dennis R. Kidd, Dewey, OK (US); Max W. Thompson, Sugar Land, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 10/116,982

(22) Filed: Apr. 5, 2002

(65) Prior Publication Data

US 2003/0188993 A1 Oct. 9, 2003

(51) Int. Cl.[7] ..... C01G 25/00; C01G 45/00; B01J 20/34; B01J 38/10; B01J 20/02

(52) U.S. Cl. ..... 208/299; 208/244; 208/247; 208/208 R; 502/53; 502/406

(58) Field of Search ..... 208/208 R, 244, 208/247, 299; 502/53, 406

(56) References Cited

U.S. PATENT DOCUMENTS 3,969,089 A 7/1976 Moss et al. ..... 48/197 R
4,336,130 A * 6/1982 Miller et al. ..... 208/243
5,439,867 A 8/1995 Khare et al. ..... 402/407
5,447,702 A 9/1995 Campbell et al. ..... 423/230
5,578,093 A 11/1996 Campbell et al. ..... 48/128
5,843,300 A * 12/1998 Zinnen et al. ..... 208/250
5,914,292 A * 6/1999 Khare et al. ..... 502/406
6,184,176 B1 2/2001 Khare ..... 502/407
6,254,766 B1 7/2001 Sughrue et al. ..... 208/244
6,271,173 B1 8/2001 Khare ..... 502/406
6,274,533 B1 8/2001 Khare ..... 502/343
6,723,229 B2 * 4/2004 Hantzer et al. ..... 208/210
6,723,230 B1 * 4/2004 Chen et al. ..... 208/213

* cited by examiner

*Primary Examiner*—Stanley S. Silverman
*Assistant Examiner*—Jonas N. Strickland
(74) *Attorney, Agent, or Firm*—Lynda S. Jolly; Bronwyn A. Welvaert

(57) ABSTRACT

In a desulfurization process for the removal of organosulfur compounds from a hydrocarbon fluid stream such as cracked-gasoline or diesel fuel wherein a bifunctional sorbent system is employed, surface treatment of the bifunctional sorbent during the use of same for desulfurization results in an extension of the useful life of the bifunctional sorbent prior to the regeneration and reactivation of same for further use in the desulfurization of the hydrocarbon fluid stream.

28 Claims, 1 Drawing Sheet

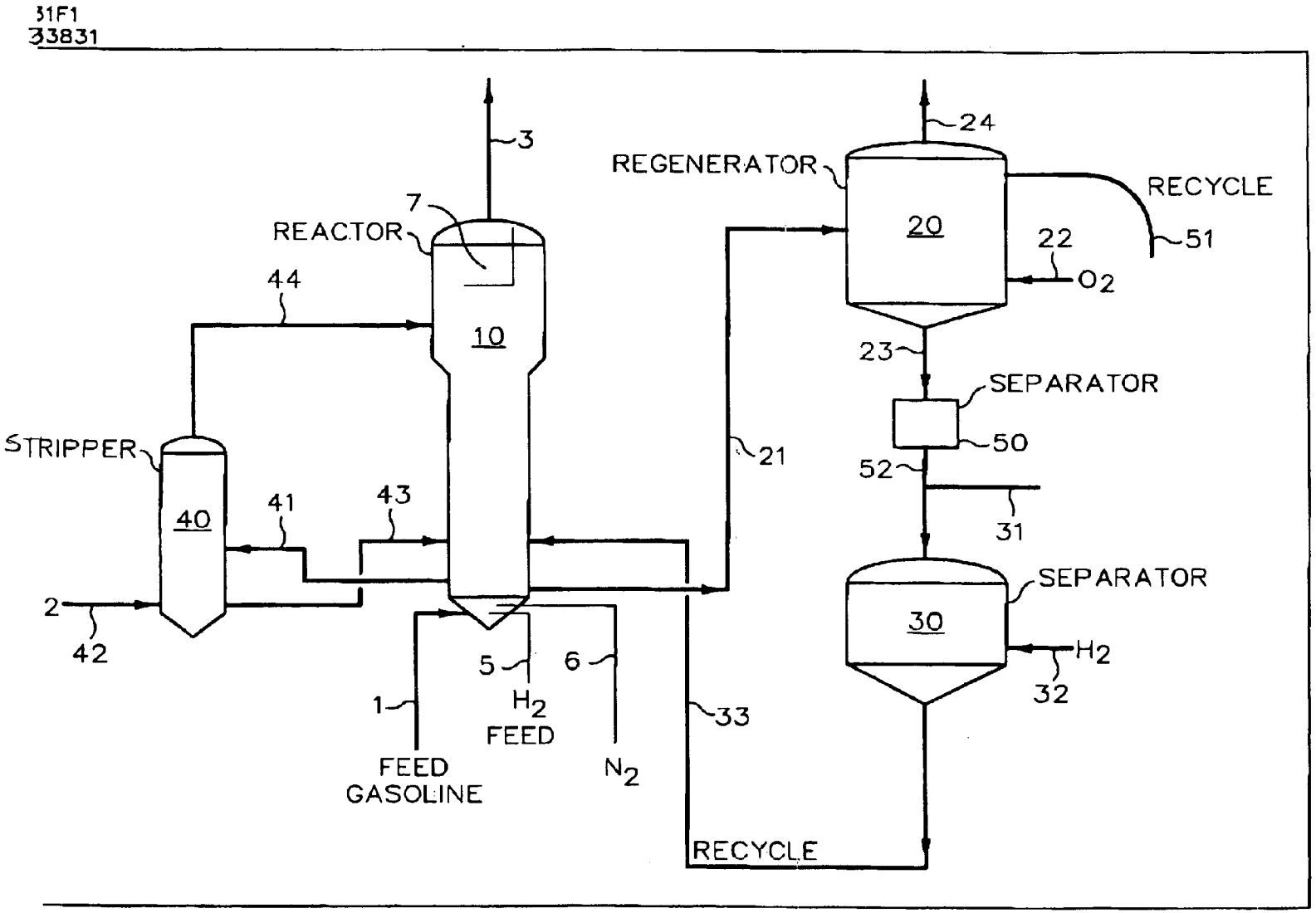
RECYCLE
51
22
O2
24
20
REGENERATOR
23
SEPARATOR
50
52
31
SEPARATOR
H2
32
30
RECYCLE
21
33
N2
6
H2
FEED
5
FEED
GASOLINE
1
3
10
7
REACTOR
43
44
41
40
STRIPPER
2
42
31F1
33831

DESULFURIZATION PROCESS

FIELD OF THE INVENTION

This invention relates to an improved process for the removal of organosulfur compounds from hydrocarbon fluid streams such as, for example, cracked-gasolines and diesel fuels.

BACKGROUND OF THE INVENTION

The need for cleaner burning fuels has resulted in a continuing world-wide effort to reduce organosulfur levels in hydrocarbon fluids containing such sulfur compounds such as gasoline and diesel fuels. The reduction of sulfur in these hydrocarbon containing fluids is considered a means for improving air quality because of the negative impact sulfur has on the performance of sulfur-sensitive items such as automotive catalytic converters. The presence of oxides of sulfur in automotive engine exhaust inhibits and can irreversibly poison noble metal catalysts in a converter. Emissions from an inefficient or poisoned converter contain levels of non-combusted, non-methane hydrocarbons, oxides of nitrogen, and carbon monoxide. Such emissions can be catalyzed by sunlight to form ground level ozone, more commonly referred to as smog.

Most of the sulfur in hydrocarbon-containing fluids, such as gasoline, comes from thermally processed gasolines. Thermally processed gasolines such as, for example, thermally cracked gasoline, visbreaker gasoline, coker gasoline and catalytically cracked gasoline (hereinafter collectively referred to as "cracked-gasoline") contain, in part, olefins, aromatics, sulfur, and sulfur-containing compounds.

Since most gasolines, such as, for example automobile gasolines, racing gasolines, aviation gasolines, boat gasolines, and mixtures thereof contain a blend of, at least in part, cracked-gasoline, reduction of sulfur in cracked-gasoline will inherently serve to reduce sulfur levels in most gasolines.

Public discussion about gasoline sulfur has not centered on whether or not sulfur levels should be reduced. Rather, consensus has emerged that lower sulfur levels in gasoline can reduce automotive emissions and improve air quality. Thus, the real debate has focused on the required level of reduction, geographical areas in need of lower sulfur gasoline, and the time frame for implementation of lower sulfur levels.

As concern over the impact of automotive air pollution continues, it is clear that further efforts to reduce sulfur levels in automotive fuels will be required. While current gasoline products contain about 330 parts per million by weight (ppmw), the U.S. Environmental Protection Agency (USEPA) recently issued regulations requiring the average sulfur content in gasoline to be less than 30 ppm average with an 80 ppm cap. By 2006, the standards will effectively require every blend of gasoline sold in the United States to meet the 30 ppm level.

In addition to the need to be able to produce low sulfur content automotive fuels, there is also a need for a process which will have a minimal effect on the olefin content of such fuels so as to maintain the octane number (both research octane number (RON) and motor octane number (MON)). Such a process is desirable since saturation of olefins can greatly affect octane number. The adverse effect on olefin content is generally due to the severe conditions normally employed, such as during hydrodesulfurization, to remove thiophenic compounds (such as, for example, thiophenes, benzothiophenes, alkyl thiophenes, alkylbenzothiophenes, alkyl dibenzothiophenes, and the like) which are some of the most difficult sulfur-containing compounds to be removed from cracked-gasoline. In addition, there is a need to avoid a system wherein the conditions are such that the aromatic content of cracked-gasoline can be lost through saturation. Thus, there is a need for a process wherein desulfurization is achieved and the octane number is maintained.

In addition to a need for removal of sulfur from cracked-gasolines, there also is a need to reduce the sulfur content in diesel fuels. In removing sulfur from diesel fuels by hydrodesulfurization, the cetane is improved but there is a large cost in hydrogen consumption. Hydrogen is consumed by both hydrodesulfurization and aromatic hydrogenation reactions.

To satisfy these needs, processes for desulfurization of cracked-gasolines or diesel fuels have been developed, as disclosed in U.S. Pat. Nos. 6,254,766 and 6,274,533. These comprise contacting an organosulfur containing hydrocarbon stream with a sorbent in a desulfurization zone, separating the desulfurized hydrocarbon stream from the resulting sulfurized sorbent composition, regenerating at least a portion of the sulfurized sorbent composition to produce a regenerated, desulfurized sorbent composition, activating at least a portion of the regenerated desulfurized sorbent composition and thereafter using at least a portion of the activated, regenerated sorbent composition for further desulfurization of a selected hydrocarbon feed stock.

While such processes represent significant contributions to the art for the desulfurization of cracked-gasoline or diesel fuels in the providing a desulfurized product having low sulfur content, there is still an opportunity for improvements to such processes.

Since the volume of desulfurization sorbent employed in carrying out desulfurization processes can be significant when the processes are practiced on a commercial scale, such as the processing of cracked-gasolines or diesel fuels, it is highly desirable that the life of the sorbent be maximized to permit extended use in a desulfurization zone prior to subjecting the sulfurized sorbent to regeneration and activation.

Accordingly, it is an object of the present invention to provide an improved process for desulfurization of cracked-gasolines or diesel fuels when using sorbent compositions.

Another object of this invention is to provide a process for extending the useful life of sorbent compositions.

A further object of this invention is to provide a process for removal of sulfur from cracked-gasolines and diesel fuels which maximizes the useful life of sorbent compositions so as to extend its life in the desulfurization zone prior to its being regenerated and reactivated.

BRIEF DESCRIPTION OF THE DRAWING

Other objects and advantages of the invention will be apparent from the following description of the invention, the claims and the drawing.

FIG. 1 is a simplified schematic flow diagram of a desulfurization process which provides for the surface treatment of the sorbent

SUMMARY OF THE INVENTION

The present invention is based upon the discovery that surface treatment of a sorbent employed for desulfurization of cracked gasoline or diesel fuel. A portion of the sorbent is removed from the desulfurization zone and at least a portion of the sorbent is subjected to a surface treatment with a reducing agent such as, for example, hydrogen. Thereafter the surface treated sorbent can be used for further desulfurization of hydrocarbon feeds. This surface treatment can result in a significant extension of the operable life of the sorbent for desulfurization of a hydrocarbon stream prior to its having to be subjected to regeneration and reactivation.

More specifically, in accordance with the present invention it has been discovered that surface treatment with a reducing agent, such as hydrogen, of a used, activated sorbent system having a base component comprising zinc oxide and a promotor component comprising at least one promoter metal can result in an extension of the useful life of the sorbent in a desulfurization zone. Such surface treatment preferably is done prior to regeneration of the sorbent for removal of the absorbed sulfur thereon and reactivation to provide a reduced valence of the promotor metal. Thus, one aspect of the present invention provides a process for removal of surface contaminants from a sorbent composition being used for desulfurization of a hydrocarbon stream such as cracked-gasolines and diesel fuels.

In another aspect of the present invention, an improvement in desulfurization processes for the removal of organosulfur compounds from a hydrocarbon stream, such as cracked-gasolines and diesel fuels is provided. This process comprises desulfurization of a hydrocarbon-containing fluid with a sorbent composition in a desulfurization zone, separating a desulfurized hydrocarbon product from the sulfurized sorbent composition, regenerating at least a portion of the sulfurized sorbent to produce a regenerated desulfurized sorbent composition, activating at least a portion of the regenerated, desulfurized sorbent composition to produce an activated, regenerated, desulfurized sorbent composition, and thereafter using at least a portion of such activated, regenerated, desulfurized sorbent composition for the further desulfurization of an organosulfur containing hydrocarbon stream, and further withdrawing a portion of the sorbent composition from the desulfurization zone and treating at least the surface of the sorbent composition with a reducing agent and then using the resulting surface treated sorbent composition for the further desulfurization of an organosulfur containing hydrocarbon stream.

DETAILED DESCRIPTION OF THE INVENTION

The present invention is based upon the discovery that treatment of the surface of a sorbent used for desulfurization of a hydrocarbon with a reducing agent such as hydrogen can result in extension of the useful life of such sorbent prior to regeneration and reactivation of the sorbent.

While not wishing to be bound by theory, it is believed that surface treatment of the sorbent can serve to remove bodies from sorbent particles, open sites for additional sulfur bonding, enhance removal of sulfur from organosulfur components in the hydrocarbon stream being desulfurized, provide for increase in sulfur content on the sorbent particles, extend the useful life of the sorbent prior to regeneration and further reduce the overall hydrogen requirement in the desulfurization reactor or desulfurization zone.

The terms "sorbent" and "bifunctional sorbent" are used interchangeably in this application and denote a dual function sorbent system which comprises (a) a base component and (b) a promotor component. The base component comprises zinc oxide and the promotor component comprises a reduced metal selected from the group consisting of nickel, cobalt, iron, manganese, tungsten, silver, gold, copper, platinum, zinc, tin, ruthenium, molybdenum, antimony, vanadium iridium, platinum, chromium and palladium.

The term "hydrocarbon containing stream" denotes any hydrocarbon containing organosulfur compounds therein. Preferably, such hydrocarbon containing stream can be useful as a fuel. Examples of such streams include, but are not limited to, cracked-gasolines, diesel fuels, jet fuels, straight run naphthas, straight run distillates, coker gas oils, coker naphthas, alkylates, straight run gas oils, and mixtures of two or more thereof.

The term "base component" as used herein denotes a composition comprising zinc oxide and an organic or inorganic compound. Preferably, the base component comprises zinc oxide and an inorganic compound comprising silica and alumina wherein at least a portion of the alumina is present as an aluminate. It is believed that the silica and alumina can provide a mesoporosity sufficient to keep the zinc and/or zinc oxide crystallite sites small and enhance the microporosity of the resulting composition such that only a minimum of the zinc oxide can form a zinc spinet support structure.

The term "promotor component" as used herein denotes any component which can be added to the sorbent composition to help promote desulfurization of a hydrocarbon stream. Such promotor components are selected from the group consisting of metals, metal oxides or precursors for the metal oxides, and mixtures thereof wherein the metal component is selected from the group consisting of nickel, cobalt, iron, manganese, tungsten, silver, gold, copper, platinum, zinc, tin, ruthenium, molybdenum, antimony, vanadium iridium, platinum, chromium, palladium, and mixtures thereof.

While not wishing to be bound by theory, it is believed that at least a portion of the promotor component extracts sulfur atoms from an organosulfur compound and at least a portion of the base component retains sulfur atoms until the bifunctional sorbent can be subjected to regeneration.

The terms "sulfur", "organosulfur", and "organosulfur compounds" are used interchangeably denote any organosulfur compounds normally present in a hydrocarbon containing stream; such as cracked gasolines or diesel fuels. Examples of organosulfur compounds which can be removed from hydrocarbon containing streams through the practice of the present invention include, but are not limited to mercaptans (RSH), organic sulfides (R—S—R), organic disulfide (R—S—S—R), thiophene, substituted thiophenes, organic trisulfides, organic tetrasulfides, benzothiophenes, alkyl thiophenes, alkylbenzothiophenes, alkyldibenzothiophenes and the like and combinations thereof as well as heavier molecular weights of the same which are normally present in a cracked-gasolines or diesel fuels of the types contemplated for use in the desulfurization process of the present invention, wherein each R can be an alkyl, cycloalkyl or aryl group containing from about one to about ten carbon atoms per R group.

The term "gasoline" denotes mixtures of hydrocarbons boiling within a range of from about 100° F. to about 400° F., or any fraction thereof. Examples of suitable gasolines include, but are not limited to, hydrocarbon streams in refineries such as naphtha, straight-run naphthas, coker naphthas, catalytic gasolines, visbreaker naphthas, alkylates, isomerates, reformates, and the like and combinations thereof.

The term "cracked-gasoline" denotes mixtures of hydrocarbons boiling within a range of from about 100° F. to about 400° F., or any fraction thereof, that are products from either thermal or catalytic processes that crack larger hydrocarbon molecules into smaller molecules. Examples of suitable thermal processes include, but are not limited to, coking, thermal cracking, visbreaking, and the like and combinations thereof. Examples of suitable catalytic cracking processes include, but are not limited to, fluid catalytic cracking (FCC), heavy oil cracking, and the like and combinations thereof. Thus, examples of suitable cracked-gasolines include, but are not limited to, coker gasolines, thermally cracked gasolines, visbreaker gasolines, fluid catalytically cracked gasolines, heavy oil cracked gasolines, and the like and combinations thereof. In some instances, cracked-gasolines can be fractionated and/or hydrotreated prior to desulfurization when used as a hydrocarbon-containing stream in a process of the present invention.

The term "diesel fuel" denotes a mixture of hydrocarbons boiling within a range of from about 300° F. to about 750° F., or any fraction thereof. Examples of suitable diesel fuels include, but are not limited to, light cycle oils, kerosenes, jet fuels, straight-run diesels, hydrotreated diesels, and the like and combinations thereof.

Sorbent systems which can be employed in the practice of the present invention are generally formed by preparing a base component, preferably in a particulated state, and then adding a promotor component, preferably by impregnation in accordance with any method known in the art.

The base component generally comprises from about 10 to about 90 weight percent zinc oxide based on the total weight of the sorbent composition, and from about 90 to about 10 weight percent inorganic or organic compound, from about 5 to about 85 weight percent silica, and from about 1 to about 30 weight percent alumina.

The promoter component usually can be present in the bifunctional sorbent composition in an amount within a range of from about 1 to about 60 weight percent promotor component based on the total weight of the sorbent composition, and preferably in an amount within a range of from about 10 to about 30 weight percent promotor component, for best sulfur removal. In addition, the promotor component can comprise more than one metallic components, such as, for example, bimetallic trimetallic, and multimetallic components. If a bimetallic promoter component is used, usually the ratio of the two metals forming such a promotor component is in a range of from about 20:1 to about 1:20. Presently preferred bimetallic components comprise nickel and cobalt in a weight ratio of about 1:1.

Additional information regarding suitable sorbent systems are disclosed in U.S. Pat. Nos. 6,274,533 and 6,184,176, the entirety of the disclosures of both are herein incorporated by reference. In general, the base component is formed by admixing the selected components and the resulting mixture subjected to particulation, preferably by spray drying. The resulting particles then are dried and calcined. A promotor component can be incorporated with the resulting particulated, calcined base component. Preferably, any impregnation incorporation techniques known in the art can be used. The resulting promoted particulates are subjected to further drying and calcination. Then, the promoted particulate is subjected to activation by reducing the valence of the promotor component with a reducing agent such as, for example, hydrogen.

Sorbent compositions having a reduced valence promotor component can react chemically and/or physically with sulfur atoms in organosulfur compounds.

Processes utilizing these sorbent compositions for the desulfurization of a hydrocarbon-containing fluid, such as a cracked-gasolines or diesel fuels, to provide desulfurized cracked-gasolines or diesel fuels comprise:

(a) desulfurizing in a desulfurization zone a selected hydrocarbon-containing stream with a sorbent composition;

(b) separating a desulfurized hydrocarbon-containing product from the resulting sulfurized sorbent compositions;

(c) regenerating at least a portion of the sulfurized sorbent compositions to produce regenerated, desulfurized, sorbent compositions;

(d) activating at least a portion of the regenerated, desulfurized, sorbent compositions to produce reduced, regenerated, desulfurized sorbent compositions; and (e) returning at least a portion of the reduced, regenerated, desulfurized sorbent compositions to the desulfurization zone.

The desulfurizing step (a) of the present invention is carried out under a set of conditions that includes total pressure, temperature, weight hourly space velocity (WHSV), and hydrogen flow. These conditions are such that the sorbent composition can desulfurize a hydrocarbon-containing fluid to produce a desulfurized hydrocarbon-containing fluid and a sulfurized sorbent composition.

In carrying out the desulfurization step of a process of the present invention, it is preferred that the hydrocarbon containing stream be in a gas or vapor phase. However, in the practice of the present invention, it is not essential that such hydrocarbon-containing fluid be totally in a gas or vapor phase.

Total reactor pressure can be within a range of from about 15 pounds per square inch absolute (psia) to about 1500 psia. However, it is presently preferred that the total pressure be within a range of from about 50 psia to about 500 psia.

In general, the temperature should be sufficient to keep the hydrocarbon-containing fluid in essentially a vapor or gas phase. While such temperatures can be within a range of from about 100° F. to about 1000° F., it is presently preferred that the temperature be within a range of from about 400° F. to about 800° F. when treating a cracked-gasoline, and within a range of from about 500° F. to about 900° F. when treating a diesel fuel.

Weight hourly space velocity ("WHSV") is defined as the numerical ratio of the rate at which a hydrocarbon-containing fluid is charged to the desulfurization zone in pounds per hour at standard conditions of temperature and pressure ("STP") divided by the pounds of sorbent composition contained in the desulfurization zone to which the hydrocarbon-containing fluid is charged. In the practice of the present invention, such WHSV should be within a range of from about 0.5 $hr^{-1}$ to about 50 $hr^{-1}$, preferably within a range of from about 1 $hr^{-1}$ to about 20 $hr^{-1}$.

In carrying out the desulfurizing step, it is presently preferred that an agent be employed which interferes with any possible chemical or physical reacting of the olefinic and aromatic compounds in the hydrocarbon-containing fluid which is being treated with the solid reduced metal containing sorbent composition. Preferably, such agent is hydrogen.

Hydrogen flow in the desulfurization zone, or reactor, generally can be such that the mole ratio of hydrogen to hydrocarbon-containing fluid is within a range of from about 0.1 to about 10, preferably in the range of from about 0.2 to about 3.

The desulfurization zone can be any zone wherein desulfurization of cracked-gasoline or diesel fuel can take place.

Examples of suitable zones are fixed bed reactors, moving bed reactors, fluidized bed reactors, transport reactors, and the like. Presently, a fluidized bed reactor or a fixed bed reactor is preferred.

If desired, during the desulfurization of the hydrocarbon, diluents such as methane, carbon dioxide, flue gas, nitrogen, and the like and combinations thereof can be used. Thus, it is not essential that a high purity hydrogen be employed in achieving the desired desulfurization of a hydrocarbon-containing fluid such as cracked-gasoline or diesel fuel.

It is presently preferred when utilizing a fluidized bed reactor system that a sorbent composition be used having a particle size within a range of from about 10 micrometers to about 1000 micrometers. Preferably, such sorbent composition should have a particle size within a range of from about 20 micrometers to about 500 micrometers, and, more preferably, within a range of from 30 micrometers to 400 micrometers. When a fixed bed reactor system is employed for the practice of a desulfurization process(s) of the present invention, the sorbent composition should generally have a particle size in the range of from about 1/32 inch to about 1/2 inch diameter, preferably within a range of from about 1/32 inch to about 1/4 inch diameter.

It is further presently preferred to use a sorbent composition having a surface area within a range of from about 1 square meter per gram ($m^2/g$) to about 1000 square meters per gram of sorbent composition, preferably within a range of from about 1 $m^2/g$ to about 800 $m^2/g$.

Separation of the desulfurized hydrocarbon-containing fluid, preferably gaseous or vaporized desulfurized cracked gasoline or diesel fuel and sulfurized sorbent composition, can be accomplished by any manner known in the art that can separate a solid from a gas. Examples of such means are cyclonic devices, settling chambers, impingement devices for separating solids and gases, and the like and combinations thereof. The desulfurized gaseous cracked-gasoline or desulfurized gaseous diesel fuel, can then be recovered and preferably liquefied. Liquification of such desulfurized hydrocarbon-containing fluid can be accomplished by any manner known in the art.

The amount of sulfur in the hydrocarbon-containing fluid, i.e. cracked-gasoline or diesel fuel, suitable for use in a process of the present invention can be within a range of from about 100 parts per million sulfur by weight of the cracked-gasoline to about 10,000 parts per million sulfur by weight of the cracked-gasoline and from about 100 parts per million sulfur by weight of the diesel fuel to about 50,000 parts per million sulfur by weight of the diesel fuel prior to the treatment of such hydrocarbon-containing fluid with the desulfurization process of the present invention.

The amount of sulfur in the desulfurized cracked-gasoline or desulfurized diesel fuel, following treatment in accordance with a desulfurization process of the present invention, is less than about 100 parts per million (ppm) sulfur by weight of hydrocarbon-containing fluid, preferably less than about 50 ppm sulfur by weight of hydrocarbon-containing fluid, and more preferably less than about 5 ppm sulfur by weight of hydrocarbon-containing fluid.

In carrying out a process of the present invention, if desired, a surface treatment, or stripper, unit can be inserted before and/or after the regeneration of the sulfurized sorbent composition. Such stripper will serve to remove a portion, preferably all, of any hydrocarbon from the sulfurized sorbent composition. Such stripper can also serve to remove oxygen and sulfur dioxide from the system prior to introduction of the regenerated sorbent composition into the sorbent activation zone (i.e., sorbent reduction zone). The stripping comprises a set of conditions that includes total pressure, temperature, and stripping agent partial pressure.

Preferably, the total pressure in a stripper, when employed, usually is within a range of from about 25 pounds per square inch absolute (psia) to about 500 psia and, preferably within a range of about 50 psia to 400 psia for ease of use. The temperature for such stripping usually is within a range of from about 100° F. to about 1000° F. and, preferably within a range of about 200° F. to about 800° F. for use of use.

The stripping agent can be any composition that can help remove hydrocarbon(s) from the sulfurized sorbent composition. Preferably, the stripping agent is a reducing agent. Most preferably, for ease of use and availability, the stripping agent is hydrogen.

The sorbent regeneration zone employs a set of conditions that includes total pressure and sulfur removing agent partial pressure. Total pressure is generally within a range of from about 25 pounds per square inch absolute (psia) to about 500 psia. The sulfur removing agent partial pressure is generally within a range of from about 1 percent to about 25 percent of the total pressure.

The sulfur removing agent is a composition that can help generate gaseous sulfur-containing compounds and oxygen-containing compounds such as sulfur dioxide, as well as to burn off any remaining hydrocarbon deposits that might be present and to restore the zinc oxide content of the bifunctional sorbent system.

The preferred sulfur removing agent suitable for use in the sorbent regeneration zone is selected from oxygen-containing gases such as air.

The temperature in the sorbent regeneration zone is generally within a range of from about 100° F. to about 1500° F., preferably within a range of from about 800° F. to about 1200° F.

The sorbent regeneration zone can be any vessel wherein the desulfurizing or regeneration of the sulfurized sorbent composition can take place.

The desulfurized sorbent composition then can be reduced in an activation zone with a reducing agent so that at least a portion of the promotor component content of the resulting sorbent composition is reduced to produce a solid reduced-valence promotor component in an amount sufficient to permit the removal of sulfur from the sulfur containing components of a cracked-gasoline or diesel fuel.

In general, when practicing the present invention, activation, i.e., reduction, of the desulfurized sorbent composition is carried out at a temperature within a range of from about 10° F. to about 1500° F. and at a pressure within a range of from about 15 pounds per square inch absolute (psia) to about 1500 psia. Such reduction can be carried out for a time sufficient to achieve the desired level of promotor component reduction contained in the sorbent composition. Such reduction can generally be achieved in a time period within a range of from about 0.01 hour to about 20 hours.

Following activation, i.e., reduction, of the regenerated sorbent composition, at least a portion of the resulting activated (i.e., reduced) bifunctional sorbent composition can be returned to the desulfurization zone.

When carrying out the process of the present invention, the steps of desulfurization, regeneration, activation (i.e., reduction), and optionally surface treatment, or stripping, before and/or after such regeneration can be accomplished in a single zone or vessel or in multiple zones or vessels.

When carrying out the process of the present invention in a fixed bed reactor system, the steps of desulfurization, regeneration, activation, and optionally stripping before and/or after such regeneration can be accomplished in a single zone or vessel.

The desulfurized cracked-gasoline can be used in the formulation of gasoline blends to provide gasoline products suitable for commercial consumption and can also be used where a cracked-gasoline containing low levels of sulfur is desired.

The desulfurized diesel fuel can be used in the formulation of diesel fuel blends to provide diesel fuel products.

Referring to FIG. 1, a presently preferred embodiment of the invention, a sulfur absorption unit is comprised of a reactor 10 operating as a single pass fluid bed system for both incoming cracked-gasoline and sorbent. In the reactor 10, sulfur containing cracked-gasoline is introduced through line 1. Hydrogen is introduced into the reactor through line 5. In addition, if desired nitrogen can be introduced in the reactor 10 through line 6. In the reactor 10 the sulfur containing cracked-gasoline is contacted with a reduced valence sorbent particles which are introduced through line 33.

The absorption of sulfur by the bifunctional sorbent results in the formation of a sulfided sorbent. This reaction is typically of low heat release and the sorbent feed rate can be large enough combined with the sorbent recirculation in the reactor to ensure an adequate pick up of sulfur per pass of the sorbent.

Desulfurized cracked-gasoline containing entrained sorbent particles is passed to a gas-solids separator 7, generally a cyclone separator. A desulfurized product gas which is substantially sorbent-free is removed through line 3. Separated sorbent particles flow through line 21 to a regenerator 20 wherein the sulfur loaded on the sorbent is oxidized to sulfur dioxide by an oxidant supply, generally air plus an diluent, introduced through the line 22. A sulfur dioxide off gas containing entrained regenerated sorbent particle passes from the regeneration unit 20 through line 23 to a gas-solids separator 50.

A substantially particulate-free sulfur dioxide off gas is removed through line 24 for recovery and/or further use. The regenerated sorbent particles recovered in the separator 50 pass through line 52 into the activator 30.

The bifunctional sorbent particles are subjected to activation so as to reduce the valence of the promotor metal content thereof in the activator 30 by the contacting of same with hydrogen which is introduced into the activator through line 32. Following activation the now activated, bifunctional sorbent composition is then returned through line 33 to the desulfurization zone 10 for further use.

In the practice of the process of the present invention, a stream of activated, bifunctional sorbent particles is removed by means of line 41 and passed to stripper, or surface treatment, unit 40 wherein the sorbent particles are subjected to a surface treatment with a reducing agent such as hydrogen which is introduced through line 42. On completion of the surface treatment of the bifunctional sorbent particles in unit 40, the resulting surface treated sorbent particles are returned through line 43 to the desulfurization unit 10 for continued use in the desulfurization of the hydrocarbon feed stream prior to the regeneration and activation of same in units 20 and 30 as above described.

While FIG. 1 represents a presently preferred embodiment of the present invention, a stripper unit can be provided internally in the absorber unit so as to permit the desired surface treating of the bifunctional sorbent to be carried out in the absorber in a similar manner to the surface treatment carried out in stripper 40.

Also, if desired, surface treatment of the bifunctional sorbent can be achieved by intermediate cessation of the flow of hydrocarbons feed to the absorber 10 while continuing feed of hydrogen under the conditions normally maintained in the absorber unit. Thus, there is carried out in the absorber a cyclic process of the desulfurization step and the hydrogen surface treatment of the bifunctional sorbent.

EXAMPLE

The following example is intended to be illustrative of the present invention and to teach one of ordinary skill in the art to make and use the invention. This example is not intended to limit the invention in any way.

This Example demonstrates the effects of surface treating, or stripping, the sorbent with hydrogen. Catalytic-cracked gasoline containing hydrogen gas and approximately 150 parts per million by weight (ppmw) sulfur were mixed and fed to the reactor, or sorbent. The reactor pressure was 65 psia and temperature was between 650 and 750° F. With time, the sulfur in the liquid product effluent from the reactor began to increase. When the effluent product sulfur reached approximately 30 ppmw, the catalytic-cracked gasoline was removed from the feed and only hydrogen was fed to the reactor for 30 minutes. A cycle of feeding catalytic-cracked gasoline plus hydrogen for one hour and then hydrogen only for 15 to 30 minutes was implemented. The product sulfur decreased approximately 10 ppmw until almost 20 pounds of catalytic-cracked gasoline per pound of sorbent had been fed to the reactor, when the product sulfur content began to increase again. The results, listed below in Table 1, demonstrate the effects of hydrogen surface treatment, or stripping.

TABLE 1

| Run Time (minutes) | Pounds of Feed/ Pounds of Sorbent | Product Sulfur (ppmw) |
|---|---|---|
| 30 | 1.4 | 3 |
| 60 | 2.8 | 12 |
| 90 | 4.2 | 21 |
| 120 | 5.6 | 34 |
| 150 | 6.9 | 23 (strip)[a] |
| 180 | 8.3 | 22 |
| 210 | 9.7 | 11 (strip)[a] |
| 24 | 12.1 | 16 |
| 270 | 11.5 | 8 (strip)[a] |
| 300 | 13.9 | 10 |
| 330 | 15.3 | 6 (strip)[a] |
| 360 | 16.7 | 10 |
| 390 | 18.1 | 55 (strip)[a] |
| 420 | 19.4 | 10 |
| 450 | 20.8 | 17 |
| 480 | 22.2 | 50 |

[a]Each strip was 15 to 30 minutes in hydrogen only; catalytic cracked gasoline feed was cut off during the strip The above data shows that to maintain 30 ppmw or less sulfur in the product without the hydrogen stripping, the sorbent would have to have been regenerated after only 5 pounds of catalytic-cracked gasoline per pound of sorbent were fed to the reactor. With hydrogen stripping, over 20 pounds of catalytic-cracked gasoline per pound of sorbent could be charged to the reactor before regeneration is required.

The specific examples herein disclosed are to be considered as being primarily illustrative. Various changes beyond those described will no doubt occur to those skilled in the art; and such changes are to be understood as forming a part of this invention in so far as they fall within the spirit and scope of the appended claims.

What is claimed is:

1. A process for enhancing the activity of a bifunctional sorbent composition to be used in desulfurization of a hydrocarbon fluid stream containing organosulfur compounds which comprises contacting the surface of said bifunctional sorbent composition with a reducing agent under conditions such that sulfur deposits on the surface of the bifunctional sorbent are removed wherein said bifunctional sorbent is a composition comprising (a) a base component and (b) a promoter component wherein said base component comprises zinc oxide and said promoter component comprises a reduced metal selected from the group consisting of nickel, cobalt, iron, manganese, tungsten, silver, gold, copper, platinum, zinc, tin, ruthenium, molybdenum, antimony, vanadium, iridium, platinum, chromium and palladium.

2. A process in accordance with claim 1 wherein the bifunctional sorbent has been removed from a desulfurization zone.

3. A process in accordance with claim 2 wherein the resulting surface treated bifunctional sorbent is returned to said desulfurization zone following surface treatment of the bifunctional sorbent.

4. A process in accordance with claim 1 wherein said reducing agent is hydrogen.

5. A process in accordance with claim 4 wherein said bifunctional sorbent is surface treated with hydrogen at a temperature within a range of about 100° F. to about 1,000° F., a pressure within a range of about 15 psia to about 1500 psia and for a time sufficient to effect the removal of deposits on the surface of said composition.

6. A process in accordance with claim 5 wherein said surface treatment is carried out for a period of time within a range of from about 1 to about 30 minutes.

7. A process for the removal of organosulfur compounds from a hydrocarbon fluid stream which comprises:

(a) contacting said stream with a bifunctional sorbent composition under conditions to produce a desulfurized hydrocarbon fluid stream and a sulfurized bifunctional sorbent;

(b) removing the desulfurized fluid stream from said desulfurization zone;

(c) passing at least a portion of the sulfurized bifunctional sorbent to a regeneration zone;

(d) regenerating at least a portion of the sulfurized bifunctional sorbent in said regeneration zone to remove at least a portion of the sulfur thereon in order to restore the sulfur removal function of the bifunctional sorbent thus producing a desulfurized sorbent;

(e) passing at least a portion of the desulfurized sorbent to an activation zone;

(f) activating at least a portion of the desulfurized sorbent in the activation zone whereby the reduced valence state promoter metal content is reestablished and the promotional activity of the bifunctional sorbent composition so as to effect removal of organosulfur compounds from a hydrocarbon fluid stream when contacted with same; and thereafter (g) using at least a portion of the resulting desulfurized activated bifunctional sorbent composition for desulfurization of a hydrocarbon fluid stream, the improvement which comprises contacting the surface of said bifunctional sorbent composition with a reducing agent under conditions such that the deposits of the surface of said bifunctional sorbent composition are removed.

8. A process in accordance with claim 7 wherein the bifunctional sorbent being contacted with a reducing agent is one that has been removed from the desulfurization zone.

9. A process in accordance with claim 8 wherein the resulting surface treated bifunctional sorbent is reintroduced to said desulfurization zone following the surface treatment of same.

10. A process in accordance with claim 8 wherein said reducing agent is hydrogen.

11. A process in accordance with claim 10 wherein said bifunctional sorbent composition is treated with hydrogen at a temperature in the range of 100° F. to about 1,000° F., a pressure in the range of about 15 to about 1500 psia and for a time sufficient to effect the removal of deposits from the surface of said bifunctional sorbent.

12. A process in accordance with claim 11 wherein said surface treatment is carried out for a period of time within a range of from about 15 to about 30 hours.

13. A process in accordance with claim 12 wherein said surface treatment remove sulfur deposits on the surface of said bifunctional sorbent.

14. A process in accordance with claim 7 wherein said bifunctional sorbent is a composition comprising (a) a base component and (b) a promoter component wherein said base component comprises zinc oxide and said promoter component comprises a reduced metal selected from the group consisting of nickel, cobalt, iron, manganese, tungsten, silver, gold, copper, platinum, zinc, tin, ruthenium, molybdenum, antimony, vanadium iridium, platinum, chromium and palladium.

15. A process for enhancing the activity of a bifunctional sorbent composition to be used in desulfurization of a hydrocarbon fluid stream containing organosulfur compounds which comprises contacting the surface of said bifunctional sorbent composition, wherein said bifunctional sorbent has been removed from a desulfurization zone, with a reducing agent under conditions such that sulfur deposits on the surface of the bifunctional sorbent are removed, and wherein the resulting surface treated bifunctional sorbent is returned to said desulfurization zone following surface treatment of said bifunctional sorbent.

16. A process in accordance with claim 15 wherein said reducing agent is hydrogen.

17. A process in accordance with claim 16 wherein said bifunctional sorbent is surface treated with hydrogen at a temperature within a range of about 100° F. to about 1,000° F., a pressure within a range of about 15 psia to about 1500 psia and for a time sufficient to effect the removal of deposits on the surface of said composition.

18. A process in accordance with claim 17 wherein said surface treatment is carried out for a period of time within a range of from about 1 to about 30 minutes.

19. A process for the removal of organosulfur compounds from a hydrocarbon fluid stream which comprises:

(a) contacting said stream with a bifunctional sorbent composition under conditions to produce a desulfurized hydrocarbon fluid stream and a sulfurized bifunctional sorbent;

(b) removing the desulfurized fluid stream from said desulfurization zone;

(c) passing at least a portion of the sulfurized bifunctional sorbent to a regeneration zone;

(d) regenerating at least a portion of the sulfurized bifunctional sorbent in said regeneration zone to remove at least a portion of the sulfur thereon in order to restore the sulfur removal function of the bifunctional sorbent thus producing a desulfurized sorbent;

(e) passing at least a portion of the desulfurized sorbent to an activation zone;

(f) activating at least a portion of the desulfurized sorbent in the activation zone whereby the reduced valence state promoter metal content is reestablished and the promotional activity of the bifunctional sorbent composition so as to effect removal of organosulfur compounds from a hydrocarbon fluid stream when contacted with same; and thereafter (g) using at least a portion of the resulting desulfurized activated bifunctional sorbent composition for desulfurization of a hydrocarbon fluid stream, the improvement which comprises contacting the surface of said bifunctional sorbent composition that has been removed from the desulfurization zone with a reducing agent under conditions such that the deposits of the surface of said bifunctional sorbent composition are removed and wherein the resulting surface treated bifunctional sorbent is reintroduced to said desulfurization zone following the surface treatment of same.

20. A process in accordance with claim 19 wherein said reducing agent is hydrogen.

21. A process in accordance with claim 20 wherein said bifunctional sorbent composition is treated with hydrogen at a temperature in the range of 100° F. to about 1,000° F., a pressure in the range of about 15 to about 1500 psia and for a time sufficient to effect the removal of deposits from the surface of said bifunctional sorbent.

22. A process in accordance with claim 21 wherein said surface treatment is carried out for a period of time within a range of from about 15 to about 30 hours.

23. A process in accordance with claim 22 wherein said surface treatment remove sulfur deposits on the surface of said bifunctional sorbent.

24. A process in accordance with claim 19 wherein said bifunctional sorbent is a composition comprising (a) a base component and (b) a promoter component wherein said base component comprises zinc oxide and said promoter component comprises a reduced metal selected from the group consisting of nickel, cobalt, iron, manganese, tungsten, silver, gold, copper, platinum, zinc, tin, ruthenium, molybdenum, antimony, vanadium iridium, platinum, chromium and palladium.

25. A process for enhancing the activity of a bifunctional sorbent composition to be used in desulfurization of a hydrocarbon fluid stream containing organosulfur compounds which consists essentially of contacting the surface of said bifunctional sorbent composition wherein the bifunctional sorbent has been removed from a desulfurization zone with a reducing agent under conditions such that sulfur deposits on the surface of the bifunctional sorbent are removed and wherein the resulting surface treated bifunctional sorbent is returned to said desulfurization zone following surface treatment of the bifunctional sorbent.

26. A process in accordance with claim 25 wherein said reducing agent is hydrogen.

27. A process in accordance with claim 26 wherein said bifunctional sorbent is surface treated with hydrogen at a temperature within a range of about 100° F. to about 1,000° F., a pressure within a range of about 15 psia to about 1500 psia and for a time sufficient to effect the removal of deposits on the surface of said composition.

28. A process in accordance with claim 27 wherein said surface treatment is carried out for a period of time within a range of from about 1 to about 30 minutes.

* * * * *